US009269476B2

(12) United States Patent
Camp, II et al.

(10) Patent No.: US 9,269,476 B2
(45) Date of Patent: Feb. 23, 2016

(54) GAS ENCAPSULATED DUAL LAYER SEPARATOR FOR A DATA COMMUNICATIONS CABLE

(71) Applicant: General Cable Technologies Corporation, Highland Heights, KY (US)

(72) Inventors: David P. Camp, II, Florence, KY (US); Brian P. Skocypec, North Attleboro, MA (US); David M. Fausz, Fort Thomas, KY (US)

(73) Assignee: General Cable Technologies Corporation, Highland Heights, KY (US)

( * ) Notice: Subject to any disclaimer, the term of this patent is extended or adjusted under 35 U.S.C. 154(b) by 0 days.

(21) Appl. No.: 13/828,217

(22) Filed: Mar. 14, 2013

(65) Prior Publication Data

US 2013/0269967 A1 Oct. 17, 2013

Related U.S. Application Data

(60) Provisional application No. 61/618,274, filed on Mar. 30, 2012.

(51) Int. Cl.
*H01B 11/04* (2006.01)
*H01B 17/36* (2006.01)
(Continued)

(52) U.S. Cl.
CPC ..... *H01B 11/04* (2013.01); *H01B 7/295* (2013.01); *H01B 11/06* (2013.01); *H01B 17/36* (2013.01)

(58) Field of Classification Search
CPC ..... H01B 11/00; H01B 11/02; H01B 11/04; H01B 11/06; H01B 11/08; H01B 7/00; H01B 7/08; H01B 7/295; H01B 7/303; H01B 7/1875
USPC ..... 174/26 G, 25 G, 16.1, 27, 29, 113 R, 174/113 AS, 113 C
See application file for complete search history.

(56) References Cited

U.S. PATENT DOCUMENTS 6,150,612 A * 11/2000 Grandy et al. ..... 174/113 C
6,288,340 B1 * 9/2001 Arnould ..... 174/113 R
(Continued)

FOREIGN PATENT DOCUMENTS

KR 20100035110 4/2010
SU 670250 7/1979

OTHER PUBLICATIONS

Schredina, O.; International Search Report and Written Opinion of the International Searching Authority, issued in International Application No. PCT/US2013/033540; dated as mailed on Jun. 27, 2013; 5 pages.
(Continued)

*Primary Examiner* — Ishwarbhai B Patel
*Assistant Examiner* — Paresh Paghadal
(74) *Attorney, Agent, or Firm* — Ulmer & Berne LLP

(57) ABSTRACT

A data communications cable is disclosed herein. The data communications cable includes a plurality of twisted pairs of conductive wires and a separator between the plurality of twisted pairs of conductive wires. The separator includes an inner member and an outer layer being supported and shaped by the inner member for completely encapsulating at least one gas pocket between the outer layer and the inner member. The outer layer prevents the plurality of twisted pairs of conductive wires from entering the at least one gas pocket.

23 Claims, 2 Drawing Sheets

(51) Int. Cl.
*H01B 11/06* (2006.01)
*H01B 7/295* (2006.01)

(56) References Cited

U.S. PATENT DOCUMENTS

| | | | | |
|---|---|---|---|---|
| 6,310,295 | B1 * | 10/2001 | Despard | 174/113 R |
| 6,424,772 | B1 * | 7/2002 | Blazer et al. | 385/110 |
| 6,566,605 | B1 * | 5/2003 | Prudhon | 174/113 C |
| 7,196,271 | B2 * | 3/2007 | Cornibert et al. | 174/113 C |
| 7,241,953 | B2 * | 7/2007 | Glew | 174/113 R |
| 7,339,116 | B2 * | 3/2008 | Gareis et al. | 174/113 R |
| 2004/0124000 | A1 * | 7/2004 | Stipes et al. | 174/113 C |
| 2005/0199415 | A1 * | 9/2005 | Glew | 174/113 C |
| 2010/0096179 | A1 | 4/2010 | Sparrowhawk et al. | |
| 2011/0220387 | A1 | 9/2011 | Szylakowski et al. | |

OTHER PUBLICATIONS

Sanchez Vargas, Hector Javier; Office Action issued in Mexican Patent Application No. MX/a/2014/011719; dated Oct. 27, 2015; 4 pages, including partial translation.

* cited by examiner

GAS ENCAPSULATED DUAL LAYER SEPARATOR FOR A DATA COMMUNICATIONS CABLE

FIELD OF THE INVENTION

The present invention relates to data communication cabling pair separation. In particular, the present invention relates to a gas-encapsulated dual layer separator for a data communications cable.

BACKGROUND OF THE INVENTION

Conventional data communications cables often include multiple twisted pairs within a protective outer jacket. Typical data cable constructions use pair separation fillers made from solid dielectric materials such as polyolefin and fluoropolymers to provide physical distance (i.e., separation) between the pairs within a cable, thereby reducing crosstalk. In the event a portion of the cable ignites, it is desirable to limit the amount of smoke produced as a result of the melting or burning of the non-conductive portions (e.g., separation filler) of the cable. It is also desirable to prevent or limit the spread of flames along the cable from one portion of the cable to another.

Turning to FIG. 1, a cross-sectional view of a conventional communications cable 100 showing a star-shaped separator 104 composed of solid filler material is shown. Cable 100 includes four twisted pairs of conductive wires 102. The twisted pairs 102 are separated by the conventional "star" shaped filler 104 which is formed of solid dielectric materials, such as polyolefin and fluoropolymers, to provide physical distance (i.e., separation) between the pairs 102 within the cable 100. An outer jacket 106 surrounds the twisted pairs 102 and filler 104.

One disadvantage to the use of separation fillers is that typical filler materials, such as fluoropolymers, have poor smoke- and flame-retardant properties. Therefore, the added material of the filler within the cable construction increases the amount of smoke that is emitted as well as the distance that flame travels along a burning cable. In order to mitigate those drawbacks, some manufacturers add flame retardants and smoke suppressants to the polyolefin and fluoropolymer materials used in the conventional fillers. However, smoke suppressants and flame retardants often increase the dielectric constant and dissipative factors of the filler, thereby adversely affecting the electrical properties of the cable construction by increasing the signal loss of the twisted pairs within close proximity to the filler.

As a result, some conventional manufacturers may "foam" the fillers in order to reduce the amount of material, where a foamed filler material is any material that is in a lightweight cellular form resulting from introduction of gas bubbles during manufacture. However, conventional foaming methods can only reduce the amount of material by no more than approximately thirty percent. Another drawback to foamed fillers is that during cable processing or manufacturing, crushing or deformation of the foamed fillers may occur resulting in compacted filler material and less separation between twisted pairs. As a result, foamed fillers often possess an undesirable imbalance between electrical and smoke/flame retardant properties.

Accordingly, in light of the above drawbacks associated with conventional fillers, separators, and cables, there is a need for a separator used in a data communications cable that reduces crosstalk between twisted pairs within the cable while simultaneously improving the flame spread and smoke emission properties of the cable.

SUMMARY OF THE INVENTION

Accordingly, the present invention provides an electrical cable assembly that includes a multilayer separator to encapsulate gas within a filler portion. The filler portion includes an inner member (e.g., a rigid inner layer cross bar frame) used to shape an outer layer that completely encapsulates gas within it.

Specifically, objects of the present invention are accomplished by a data communications cable that includes a plurality of twisted pairs of conductive wires and a separator between the plurality of twisted pairs of conductive wires. The separator includes an inner member and an outer layer being supported and shaped by the inner member for completely encapsulating at least one gas pocket between the outer layer and the inner member. The outer layer prevents the plurality of twisted pairs of conductive wires from entering the at least one gas pocket.

With those and other objects, advantages, and features of the invention that may become hereinafter apparent, the nature of the invention may be more clearly understood by reference to the following detailed description of the invention, the appended claims, and the several drawings attached herein.

DETAILED DESCRIPTION OF THE PREFERRED EMBODIMENTS

Figure 1:
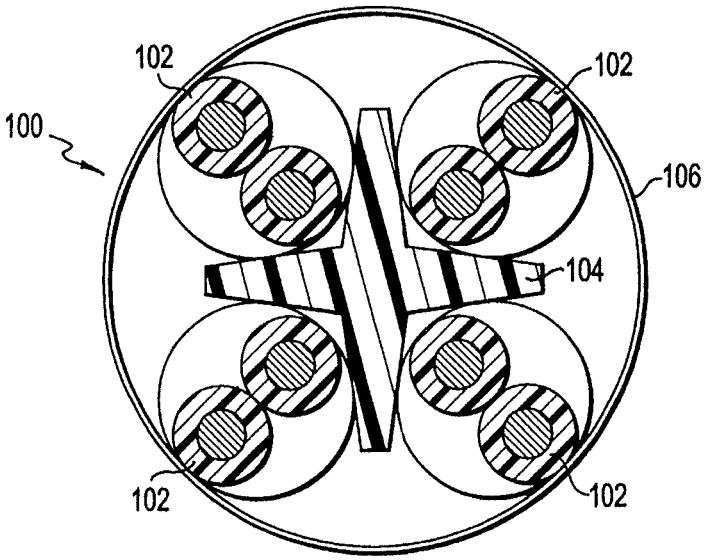
FIG. 1 (PRIOR ART)
FIG. 1 is a cross-sectional view of a conventional communications cable showing a star-shaped separator composed of solid filler material.

Several preferred embodiments of the invention are described for illustrative purposes, it being understood that the invention may be embodied in other forms not specifically shown in the drawings. It is an object of the invention to provide a cable assembly that reduces cross talk between pairs within data communications cables while simultaneously improving the flame spread and smoke emission properties of said cables. That may be accomplished by reducing the amount of filler material used in the data cable construction and replacing the filler with air, which has improved electrical properties.

Figure 2:
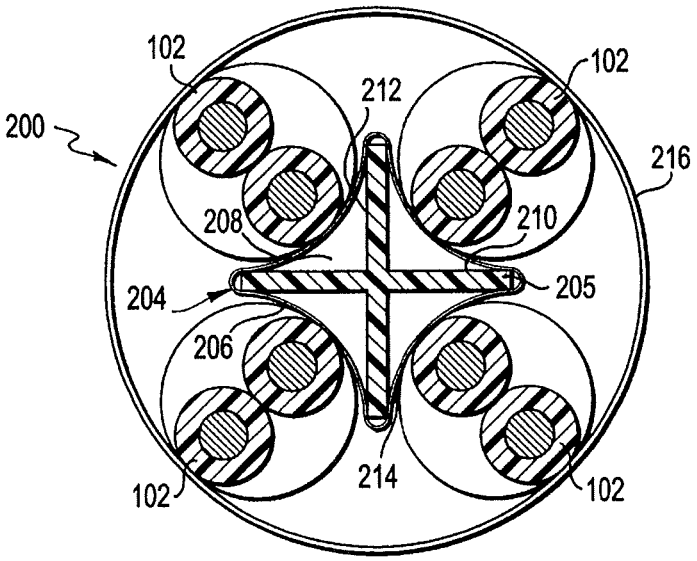
FIG. 2 is a cross-sectional view of a communications cable having a gas-encapsulated dual layer separator in accordance with an exemplary embodiment of the present invention.

As seen in FIG. 2, a cross-sectional view of a communications cable 200 in accordance with an exemplary embodiment of the present invention is shown. The cable 200 includes a plurality of twisted pairs 102 being physically separated from one other by a separator 204. The separator 204 extends longitudinally within the cable 200 to separate the wire pairs 102. However, in contrast to the conventional filler 104, the separator 204 includes two layers; an inner member 205 within an outer layer 206. The inner member 205 is preferably constructed such that it shapes the outer layer 206 where both the inner and outer layers 205 and 206 encapsulate the gas in one or more gas pockets 208. Inner member 205 may comprise one or more segments, for example. In one possible configuration, two segments 210 and 212 may be used to form a generally cross bar frame, as shown in FIG. 2. Thus, cable 200 may include four gas pockets 208 defined by the inner member 205 and the outer layer 206 which provide physical separation between the twisted pairs 102. The gas pockets 208 may be substantially triangular in cross-sectional shape, however, it is appreciated that any suitable cross-sectional shape may be used without departing from the scope of the subject matter described herein. The outer layer 206 preferably curves at each gas pocket 208 to a recessed area 214 for accepting the individual twisted pairs 102.

The separator 204 may be formed of melt processable materials, such as fluoropolymers, foamed or solid polyetherimides (PEI), polyetherimide-siloxane blends and copolymers, polyvinylchorides, polyolefins, polyethylenes, or the like. The separator 204 may also be formed at least in part by non-melt processable materials, such as PTFE, rubber, glass, silicone, or the like, by a combination of gas (e.g., air) and melt processable materials, such as is achieved with foaming. In one possible embodiment, the inner member 205 may be comprised of an olefin that is heavily loaded with a flame retardant and which has a higher dielectric constant and heat dissipation factor than an olefin that does not contain such additives. The outer layer 206 may be comprised of a thin layer of flouropolymer that has a much lower dielectric constant and dissipative factor than the inner member 205. That combination allows the cable 200 to have improved smoke- and flame-retardant properties as compared with single layer or solid fillers, such as filler 104 of cable 100, without degrading its electrical properties.

In the exemplary embodiment shown in FIG. 2, the communications cable 200 may also comprise a protective outer casing or jacket 216 for encasing the components of the cable 200 that are shown in FIG. 2 (i.e., at least one twisted wire pair 102, the inner member 205 received in the jacket 216, an outer layer 206 being supported or shaped by the inner member 205, and one or more gas pockets 208 located between the inner member 205 and the outer layer 206). As illustrated in FIG. 2, the segments of inner member 205 are substantially perpendicular to one other and intersect at a central junction point. The gas pockets 208 are preferably completely encapsulated between the outer layer 206 and the inner members 205. The gas pockets 208 provide physical separation between the outer layer 206 and the portions of the inner segments near the central junction point, whereby the at least one twisted wire pair 102 is prevented, by the outer layer 206, from entering the gas pockets 208.

By encapsulating gas within the separator 204, the cable 200 reduces the amount of material used to separate the twisted pairs 102 as compared with conventional cable separators. It is appreciated that single gasses, such as nitrogen, or mixtures of two or more gasses, such as air, may be encapsulated within the separator 204 without departing from the scope of the subject matter described herein. Such gasses may be either inert or non-inert (i.e., reactive). They may also be used in foaming of the separator 204. By introducing the gas pockets 208 created by the outer layer 206 and the inner member 205, the cable 200 reduces crosstalk interference between the twisted pairs 102 while also improving the smoke/flame performance and the dielectric properties of the cable 200. The outer layer 206 preferably has a shape that pushes the twisted wire pairs 102 away from the cable's 200 center and away from each other to reduce interference between the wire pairs 102. For example, the outer layer 206 in combination with inner member 205 causes the wire pairs 102 to be positioned radially outwardly by about at least 0.003-0.010 inches more than if the outer layer 206 and gas pockets 208 were not employed. Moreover, the cable 200 achieves the desired pair-to-pair distance using less material than if the dual layer gas-encapsulated separator disclosed herein was not used. For example, the amount of filler material may be reduced by approximately 30-45% using the gas-encapsulated dual layer separator 204 of cable 200. Less material also makes the cable significantly less expensive to manufacture.

Another advantage of cable 200 is that gas that is encapsulated inside the outer layer 206 lowers the effective dielectric constant and, therefore, may reduce the signal loss of cable 200 as compared with cable 100.

Yet another advantage of the cable 200 is that the dual layer separator 204 may allow a manufacturer to optimize the flame and smoke retardant properties of the cable 200. For example, optimization of the layers (i.e., inner member 205 and outer layer 206) may allow the cable 200 to meet industry standards, such as the National Fire Protection Association (NFPA) 262 plenum test or the Underwriters Laboratories (UL) 1666 riser test for smoke/flame retardancy, while simultaneously maintaining the desirable electrical properties needed to meet requirements (e.g., insertion loss) for data communications cables.

Figure 3:
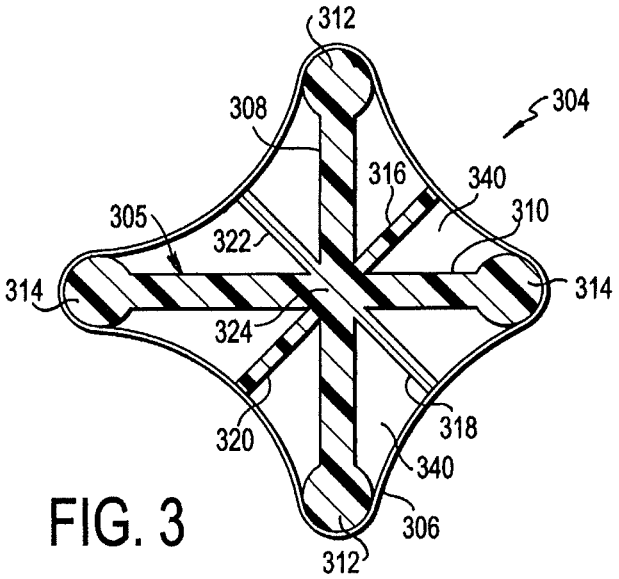
FIG. 3 is a cross-sectional view of a gas-encapsulated dual layer separator for use in a communications cable in accordance with another exemplary embodiment of the present invention.

FIG. 3 is a cross-sectional view of a gas-encapsulated dual layer separator 304 in accordance with an exemplary embodiment of the present invention. Referring to FIG. 3, the separator 304 includes an inner member 305 that may be divided into a plurality of segments, with each segment having a terminal end and intersecting at a junction point. For example, in the embodiment shown in FIG. 3, the inner member 305 may include primary segments 308 and 310 which are arranged generally perpendicular to one another in a cross-sectional plane of the cable. The segments 308 and 310 may be offset from one another to create gas pockets of different sizes. The segment 308 includes opposing terminal ends 312 and the segment 310 includes opposing terminal ends 314. It will be appreciated that while rounded terminal ends 312 and 314 are shown, other configurations are possible without departing from the scope of the subject matter described herein. Rounded terminal ends 312 and 314 may allow for shaping the outer layer 306 differently than non-rounded terminal ends, such as are shown in FIG. 2. For example, terminal ends 312 and 314 may be shaped so as to provide additional curvature or cradling around each of the twisted pairs 102.

The embodiment shown in FIG. 3 further includes secondary segments 316, 318, 320, and 322 for providing additional support for shaping of the outer layer 306. By supporting the outer layer 306, the size of the gas pockets 340 may be preserved during manufacturing, shipment, or usage so that the twisted pairs 102 maintain a proper separation distance and, thus, the cable can maintain its expected electrical and/or burn properties. In the embodiment shown in FIG. 3, the secondary segments 316-322 are arranged generally perpendicularly to one another in a cross-sectional plane of the cable and angled from the orientation of the primary segments 308 and 310 by about forty five degrees. That doubles the number of gas pockets 340 from four to eight and increases the rigidity of the cable 200.

The primary segments 308 and 310 and the secondary segments 316-322 each include a terminal end which is remote from a junction point 324 of the segments. As mentioned above, the gas pockets 340 represent the reduction of material to sufficiently space the wire pairs 102 to reduce interference. The reduction in material reduces manufacturing costs and reduces the amount of combustible material, thereby improving the smoke and flame performance of the cable 200.

Figure 4:
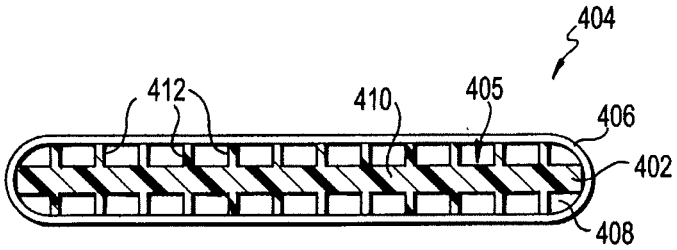
FIG. 4 is a cross-sectional view of a gas-encapsulated dual layer separator in accordance with yet another exemplary embodiment of the present invention.

FIG. 4 is a cross-sectional view of still another embodiment of a gas-encapsulated dual layer separator. Unlike the previous embodiments for use in a cable, such as cable 200, the separator 404 is a substantially flat tape with several smaller gas pockets. Referring to FIG. 4, the separator 404 includes an inner member 405 that has a primary segment 410 and a plurality of smaller, secondary segments 412 which provide support for shaping an outer layer 406 and creating a plurality of gas pockets 408. In this flattened configuration shown in FIG. 4, the number and size of the gas pockets 408 may be optimized for desired electrical and/or burn characteristics of the cable.

Figure 5:
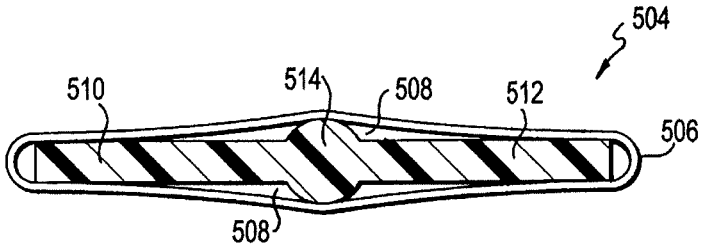
FIG. 5 is a cross-sectional view of a gas-encapsulated dual layer separator and in accordance with still another exemplary embodiment of the present invention.

FIG. 5 is a cross-sectional view of another gas-encapsulated dual layer separator 504 and fewer larger gas pockets 508 in accordance with an exemplary embodiment of the present invention. Referring to FIG. 5, separator 504 includes an inner member 505 that has two primary segments 510 and 512, which are joined at junction point 514. The primary segments 510 and 512 and the junction 514 may form one piece. As with the embodiments above, the outer layer wraps around the inner member 505 to form completely enclosed gas pockets 508 therebetween. Similar to the separator 304, the separator 504 has a substantially flattened shape and is preferably a tape.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A data communications cable comprising:

a plurality of twisted pairs of conductive wires; and a separator between the plurality of twisted pairs of conductive wires, wherein said separator includes:

an inner member; and an outer layer being supported and shaped by said inner member for completely encapsulating at least one gas pocket between said outer layer and said inner member, wherein said outer layer prevents said plurality of twisted pairs of conductive wires from entering said at least one gas pocket;

wherein said outer layer has a lower dielectric constant than the inner member.

2. The communications cable of claim 1 wherein said inner member includes one or more segments.

3. The communications cable of claim 2, wherein said one or more segments form a cross web, thereby defining a plurality of gas pockets.

4. The communications cable of claim 1 wherein said inner member is formed of a rigid or semi-rigid material.

5. The communications cable of claim 1 wherein said separator is composed of one of melt processable materials, non-melt processable materials, and a combination of gas and melt processable materials.

6. The communications cable of claim 5 wherein said melt processable materials include one of fluoroploymers, polyetherimides, polyetherimide-siloxane blend, polyvinylchorides, polyolefins, and polyethylenes.

7. The communications cable of claim 5 wherein said non-melt processable materials include one such as polytetrafluoroethylene (PTFE), rubber, glass, and silicone.

8. The communications cable of claim 1 wherein said inner member is formed of an olefin material.

9. The communications cable of claim 1 wherein said inner member includes a flame retardant additive.

10. The communications cable of claim 1 wherein said inner member has a higher electrical dissipation factor than said outer layer.

11. The communications cable of claim 1 wherein said outer layer includes a layer of fluoropolymer material.

12. The communications cable of claim 1 wherein said outer layer has a lower electrical dissipation factor than said inner member.

13. The communications cable according to claim 1, wherein each of said at least one gas pocket has a generally triangular cross-sectional shape.

14. The communications cable according to claim 1, wherein each of said at least one gas pocket has a generally square cross-sectional shape.

15. The communications cable according to claim 1, wherein said inner member includes terminal ends each having a rounded shape.

16. The communications cable according to claim 1, wherein said separator has a substantially flat shape.

17. The communications cable according to claim 1, wherein said inner member includes a primary inner member and a secondary inner member, where said primary inner member is rotationally offset from said secondary inner member by approximately forty five degrees in a cross-sectional plane of said cable.

18. The communications cable according to claim 1, wherein said inner member includes a plurality of segments which are arranged generally perpendicular to one another in a cross-sectional plane of said cable.

19. The communications cable according to claim 1, wherein said gas pocket includes one of a single gas or a mixture of two or more different gasses.

20. The communications cable according to claim 1, wherein said gas pocket includes only nitrogen.

21. The communications cable according to claim 1, wherein said gas pocket includes only air.

22. The communications cable according to claim 1, wherein at least one of said gasses is inert.

23. A separator in a data communications cable, the separator comprising:

an inner member; and an outer layer being supported and shaped by said inner member for completely encapsulating at least one gas pocket between said outer layer and said inner member;

wherein said outer layer has a lower dielectric constant than the inner member.

* * * * *

UNITED STATES PATENT AND TRADEMARK OFFICE

CERTIFICATE OF CORRECTION

PATENT NO. : 9,269,476 B2
APPLICATION NO. : 13/828217
DATED : February 23, 2016
INVENTOR(S) : David P. Camp, II et al.

It is certified that error appears in the above-identified patent and that said Letters Patent is hereby corrected as shown below:

Claims:

Claim 6, column 6, line 6, change “fluoroploymers” to --fluoropolymers--.

Signed and Sealed this
Third Day of May, 2016

Michelle K. Lee

Michelle K. Lee
*Director of the United States Patent and Trademark Office*